350-452 SR
XR 4,035,681

United Sta

Savage, Jr.

[11] 4,035,681

[45] July 12, 1977

[54] POLYGONAL LENS

[76] Inventor: John M. Savage, Jr., 8118 W. 83rd St., Playa del Rey, Calif. 90291

[21] Appl. No.: 643,158

[22] Filed: Dec. 22, 1975

[51] Int. Cl.² ..... H01J 5/16

[52] U.S. Cl. ..... 313/110; 240/106.1; 350/211

[58] Field of Search ..... 240/106.1; 313/110, 313/111; 350/211; 357/17, 73

[56] References Cited

U.S. PATENT DOCUMENTS

| | | | |
|---|---|---|---|
| 3,344,268 | 9/1967 | Fouke | 240/106 |
| 3,805,347 | 4/1974 | Collins et al. | 357/73 X |
| 3,873,979 | 3/1975 | Craford et al. | 357/17 X |

*Primary Examiner*—Rudolph V. Rolinec
*Assistant Examiner*—Lawrence J. Dahl
*Attorney, Agent, or Firm*—William W. Haefliger

[57] ABSTRACT

A lens cap, for use with a light emitting diode, comprises:

a. an end wall and a side wall defining a skirt integral with said end wall,
b. the skirt being polygonal and defining interior corners,
c. the skirt interior surface defining serrations extending lengthwise toward said end wall, and
d. the skirt side wall thickness at the corners being substantially the same as the skirt side wall thickness between said corners.

14 Claims, 9 Drawing Figures

4035681
OR IN 313/110

POLYGONAL LENS

BACKGROUND OF THE INVENTION

This invention relates generally to light emitting diode devices and apparatus; more specifically, it relates to improvements in lens caps and housings receiving and mounting light emitting diodes (LEDs).

In the past, such lens caps have been rounded or curved throughout their cross section, in order to conform to the cross sections of LEDs. In certain instances, it is desirable to employ lends caps of polygonal cross section; however, no way was known to accomplish this in the unusually advantageous manner as now afforded by the invention, providing desired luminosity which does not deteriorate near cap corners. and also providing ease of connection of the cap to, and disconnection of the cap from an LED housing attachable to a display panel. In this regard, a row of rectangular or square LED lens caps, is much more desirable on certain devices then circular cross section caps.

SUMMARY OF THE INVENTION

It is a major object of the invention to provide a polygonal cross section LED lens cap characterized as having the advantages as described, as well as additional advantages in relation to the LED housing to which it is removably attached. Basically, the cap comprises:

a. an end wall and a side wall defining a skirt integral with said end wall, b. the skirt being polygonal and defining interior corners, c. the skirt interior surface defining serrations extending lengthwise toward said end wall, and d. the skirt side wall thickness at the corners being substantially the same as the skirt side wall thickness between said corners.

As will be seen, the skirt interior serrations that extend lengthwise parallel to a skirt corner typically define a flat at each such interior corner, the flat facing an exterior corner surface that is made convex to merge with the exterior surfaces of skirt wall portions, whereby desired luminosity is not diminished at the corners, the serrations refracting the light from the LED to optimize the luminosity of the cap. In addition, the end wall exterior surface, may define radially spaced serrations having circular arcs which diminish in length proximate the corners, as will be seen. Accordingly, luminosity of the end wall of the cap is optimized, and not diminished near the corners of that end wall.

Additional objects and advantages include the provision of polygonal cap skirt corner slits extending lengthwise from the end of the skirt furthest from the serrated end wall; the provision of external bosses on skirt sections between such corner slits and receivable in recesses formed in a housing polygonal head into which skirt is receivable to lock to the housing after insertion of the LED; and the provision of additional features of construction as will be described and facilitating improvements in mode of operation and desired results.

These and other objects and advantages of the invention, as well as the details of an illustrative embodiment, will be more fully understood from the following description and drawings, in which:

DRAWING DESCRIPTION

DETAILED DESCRIPTION

Figure 1:
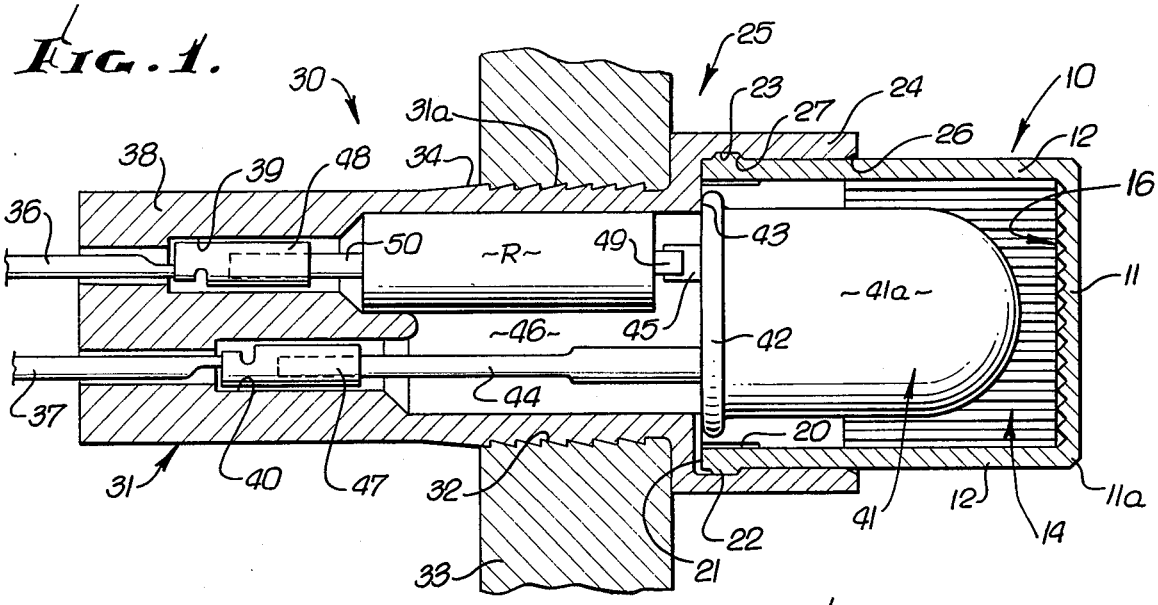
FIG. 1 is an elevation, in section, showing the assembled lens cap, body or housing, and LED.

In FIGS. 1–4, the illustrated LED lens cap 10 basically comprises an end wall 11 and a side wall or walls 12 defining a polygonal skirt integral with the end wall; for example, the skirt defines a central axis 13 and typically has a rectangular or square cross sections in planes normal to that axis. Further, the skirt interior surface typically defines serrations 14 extending lengthwise toward that peripheral portion 11*a* of the rectangular or square end wall which joins the side walls; also, the skirt side wall thickness $t_1$ at the interior corners 12*a* between or joining the side walls is substantially the same as the skirt side wall thickness $t_2$ at locations between such corners.

Toward achievement of the $t_1$ $\delta t_2$ relationship, the serrations 14 typically and advantageously define a flat 14*a* at each interior corner 12*a*, and the skirt exterior surface is outwardly convex at each exterior corner location 12*b*. Further, the flat 14*a* interconnects the roots of serrations 14 on successive skirt wall portions in a direction about axis 13. Also, the convex surface at the interior corner 12*b* merges with the outer surfaces of the walls 12. As a result, the external luminosity of the lens cap (interiorly illuminated by the LED) is optimized, and particularly without diminution at the cap corners, as described. Note that serrations 14 have triangular cross sections in planes normal to axis 13, as seen in FIG. 3.

Figure 3:
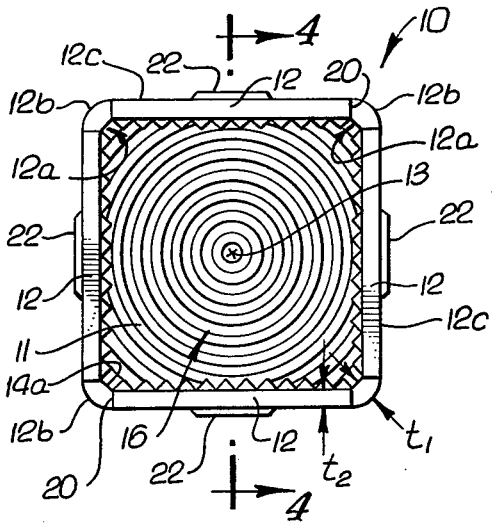
FIG. 3 is an end view on lines 3—3 of FIG. 2.
Figure 4:
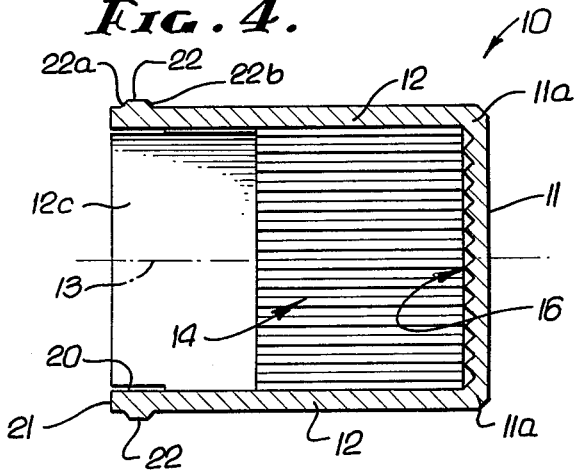
FIG. 4 is a section on lines 4—4 of FIG. 3.
Figure 9:
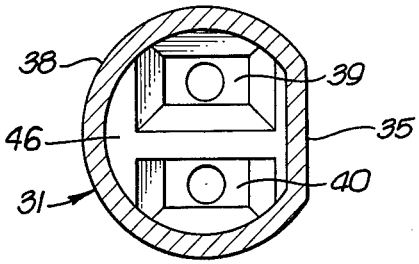
FIG. 9 is a section on lines 9—9 of FIG. 7.
Figure 5:
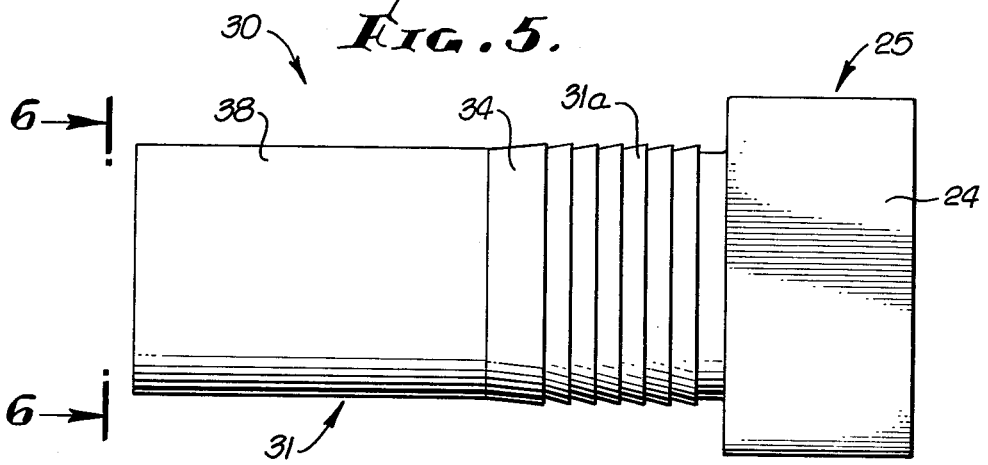
FIG. 5 is an exterior top plan view showing the body.
Figure 6:
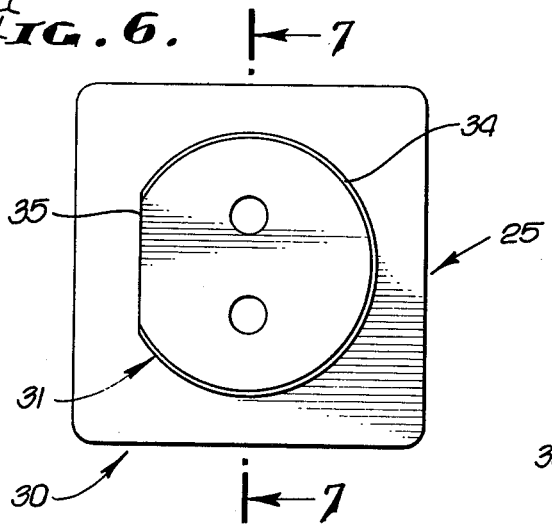
FIG. 6 is an end elevation on lines 6—6 of FIG. 5.

As seen in FIGS. 3 and 4, the end wall 11 has an interior surface defining radially spaced serrations 16 which extend circularly about axis 13. Proximate the corners 12*a*, the serrations 16 extend as circular arcs which have progressively diminishing length. The serrations 16 also have triangular cross sections in axial radial planes, as is clear from FIG. 4. Opposite faces of each serration may advantageously intersect at a 90° angle, as is also true with respect to serrations 14.

Figure 2:
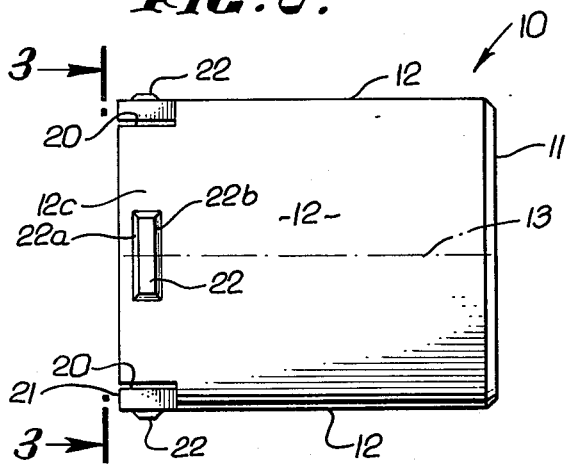
FIG. 2 is an exterior side elevation showing the lens cap.
Figure 8:
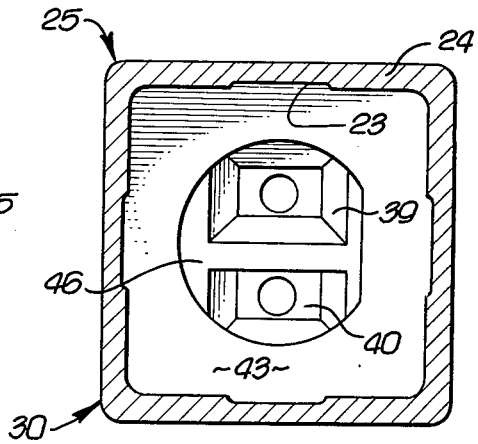
FIG. 8 is a section on lines 8—8 of FIG. 7.
Figure 7:
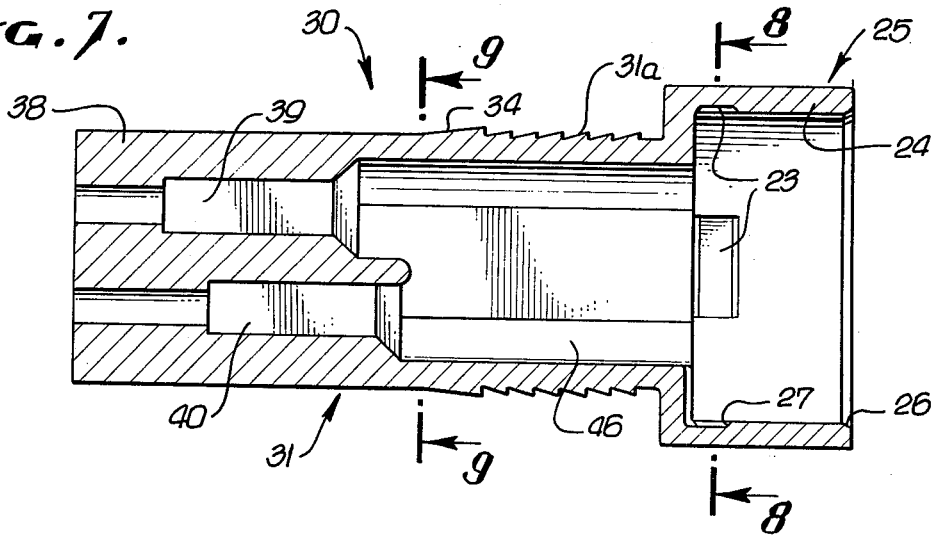
FIG. 7 is a section on lines 7—7 of FIG. 6.

As is clear from FIGS. 2–4, the skirt 12 contains corner slits 20 extending lengthwise of the skirt from the opposite end 21 furthest from end wall 11, and toward the latter. The lengths of such slits are preferably less than half the full skirt length, and they separate the side walls into sections 12*c* on which outwardly extending bosses 22 are formed approximately midway between the corner slits. The bosses extend transversely and are sized to be received in recesses 23 formed in the walls 24 of the enlarged head 25 of LED housing 30, as seen in FIGS. 7 and 8. In this regard, the bosses have cam shoulders 22*a* and 22*b* at their axially opposite ends, shoulder 22*a* of each boss being engageable with the tapered edge 26 of a head wall 24, to deflect the skirt section inwardly upon insertion of the skirt into the head 25. Bosses 22 resiliently snap outwardly into grooves 23 upon full insertion of the skirt into the head. Shoulder 22*b* of each boss is engageable with the tapered edge 27 of the groove to deflect the skirt section inwardly upon retraction of the cap from the head. The latter has a generally polygonal, and preferably rectangular or square (as illustrated) cross section, as seen in FIG. 8, thereby to form a socket conforming to or matching the cross section of the inserted lens cap skirt.

Extending the description to FIGS. 1 and 5–8, the plastic housing 30 includes a generally cylindrical section 31 integral with head 25. Section 31 includes external serrated section 31*a* adapted to fit into an opening 32 in a display panel 33, a rearward taper 34 on the section 31 facilitating such rearward insertion. A flat 35 on section 31 is adapted to match and guide on a corresponding flat defined by the panel opening.

Terminal pins 36 and 37 extend axially rearwardly through the rear wall 38 of the housing, and also project into axial bores or openings 39 and 40 formed in the section 31. Conductive clips 47 and 48 are attached to or integral with the posts.

A light emitting diode is shown at 41 in FIG. 1 as having a head 41*a*, an external flange or boss 42 seating rearwardly against housing shoulder or wall 43. The diode also includes relatively long and short terminals 44 and 45 projecting rearwardly into a hollow 46 formed in the housing section 31. A resistor R includes opposite end tab 49 and terminal 50, the former integrally attached to the short terminal 45, so that the diode and resistor form a unit insertable rearwardly into the housing (with the lens cap removed) to effect bayonet connection of terminal 44 to clip 47 and of resistor terminal 50 to clip 48. Note the differential rearward axial projection of terminals 44 and 50, to interfit the correspondingly axially offset clips 47 and 48. Accordingly, for the diode flange to engage wall 43, terminal 50 cannot be inserted into clip 47, but must be inserted into clip 48, preventing improper connection of the diode and resistor unit to the clips 47 and 48. In this regard, reference is made to my U.S. Pat. No. 3,887,803.

I claim:

1. For combination with a light emitting diode, a lens cap comprising a. an end wall and a side wall defining a skirt integral with said end wall, b. the skirt being polygonal and defining interior corners, c. the skirt interior surface defining serrations extending lengthwise toward said end wall, the serrations having roots, d. the skirt side wall thickness at the corners being substantially the same as the skirt side wall thickness between said corners and at the serration roots, said corners being free of said serrations, e. said end wall having an interior surface defining radially spaced serrations which extend circularly about an axis defined by the skirt, said end wall serrations extending as circular arcs having progressively diminishing length, proximate said corners.

2. The lens cap of claim 1 wherein the skirt defines an axis, and has generally rectangular cross sections in planes normal to said axis.

3. The lens cap of claim 1 wherein said serrations define a flat at each interior corner, the skirt exterior surface being outwardly convex at each exterior corner to merge with skirt surfaces adjacent that corner, said flat interior corner facing said convex exterior corner, said flat interconnecting roots of serrations on successive wall portions.

4. The lens cap of claim 1 wherein the end wall serrations have triangular cross sections in axial radial planes.

5. The lens cap of claim 3 wherein said side wall serrations have triangular cross sections in planes normal to an axis defined by the skirt.

6. The lens cap of claim 1 wherein the skirt contains corner slits extending lengthwise of the skirt from the end thereof furthest from said end wall.

7. The lens cap of claim 6 including at least one boss on a skirt section intermediate two corner slits and receivable in a recess formed in a wall of an LED housing into which said skirt is endwise receivable.

8. The combination that includes the lens cap and housing of claim 7, the cap skirt received in an enlarged head formed by the housing and the boss received in said recess.

9. The combination of claim 8 including an LED in said housing.

10. The combination of claim 8 wherein said housing head and cap define a central axis, and said head and cap skirt have substantially matching polygonal cross sections in planes normal to said axis.

11. The combination of claim 1 wherein said cross sections are substantially square.

12. The combination of claim 11 wherein there are four of said bosses respectively on four of said skirt sections, each skirt section formed between two corner slits, and there are four housing head walls each containing one recess to receive one boss.

13. The combination of claim 8 including the LED projecting within the lens cap, and in spaced relation to said serrations.

14. For combination with a light emitting diode, a lens cap comprising a. an end wall and a side wall defining skirt integral with said end wall, b. the skirt defining interior corners, c. the skirt interior surface defining serrations extending lengthwise toward said end wall, the serrations having roots, d. the skirt side wall thickness at the corners being substantially the same as the skirt side wall thickness between said corners and the serration roots, e. the skirt defining an axis and having generally rectangular cross sections in planes normal to said axis, f. said skirt defining a flat at each interior corner, the skirt exterior surface being outwardly convex at each exterior corner to merge with skirt surfaces adjacent that corner, said flat interior corner facing said convex exterior corner, said flat interconnecting roots of serrations on successive wall portions, and g. the end wall having an interior surface defining serrations which extend about said axis, said end wall serrations having diminished length proximate said corners.

* * * * *